US006732749B2

(12) United States Patent
Myland

(10) Patent No.: US 6,732,749 B2
(45) Date of Patent: May 11, 2004

(54) PARTICLE BARRIER DRAIN

(75) Inventor: Larry Myland, West Chester, PA (US)

(73) Assignee: Akrion, LLC, Allentown, PA (US)

( * ) Notice: Subject to any disclaimer, the term of this patent is extended or adjusted under 35 U.S.C. 154(b) by 136 days.

(21) Appl. No.: 10/014,121

(22) Filed: Dec. 11, 2001

(65) Prior Publication Data

US 2002/0078978 A1 Jun. 27, 2002

Related U.S. Application Data

(60) Provisional application No. 60/257,562, filed on Dec. 22, 2000.

(51) Int. Cl.[7] ..... B08B 3/04

(52) U.S. Cl. ..... 134/25.4; 134/26; 134/186; 134/902

(58) Field of Search ..... 134/25.4, 26, 104.2, 134/135, 155, 186, 902

(56) References Cited

U.S. PATENT DOCUMENTS

| | | | | |
|---|---|---|---|---|
| 4,753,258 | A | * | 6/1988 | Seiichiro |
| 5,054,519 | A | * | 10/1991 | Berman |
| 5,071,488 | A | * | 12/1991 | Takayama et al. |
| 5,505,785 | A | | 4/1996 | Ferrell |
| 5,839,456 | A | * | 11/1998 | Han |
| 5,845,663 | A | * | 12/1998 | Han |
| 6,001,191 | A | * | 12/1999 | Kamikawa et al. |
| 6,158,445 | A | | 12/2000 | Olesen et al. |
| 6,164,297 | A | * | 12/2000 | Kamikawa |
| 6,165,277 | A | | 12/2000 | Florez |
| 6,179,930 | B1 | * | 1/2001 | Ide et al. |
| 6,199,563 | B1 | | 3/2001 | Uehara et al. |
| 6,199,564 | B1 | * | 3/2001 | Yokomizo |
| 6,241,827 | B1 | * | 6/2001 | Tanaka et al. |
| 6,412,501 | B1 | * | 7/2002 | Onoda et al. |
| 2001/0004899 | A1 | | 6/2001 | Yokomizo |
| 2001/0017148 | A1 | | 8/2001 | Kawaguchi |

FOREIGN PATENT DOCUMENTS

| | | | |
|---|---|---|---|
| DE | 3824138 | * | 1/1990 |
| JP | 3-254129 | * | 11/1991 |
| JP | 5-152273 | * | 6/1993 |
| JP | 5-182943 | * | 7/1993 |
| JP | 5-283386 | * | 10/1993 |
| JP | 9-129883 | * | 5/1997 |
| JP | 11-12746 | * | 1/1999 |

* cited by examiner

*Primary Examiner*—Frankie L. Stinson
(74) *Attorney, Agent, or Firm*—Cozen O'Connor, P.C.; Michael B. Fein, Esq.; Brian L. Belles, Esq.

(57) ABSTRACT

A system and method for reducing the amount of contaminants that come into contact with wafer substrates during the production of integrated circuit devices. The system allows for uniform overflow of processing liquid from a process tank while preventing contaminants from reentering the process tank and contacting the wafers. The system in one aspect comprises an inner weir with a top surface, and overflow wall with at least one recess having a bottom, and a structure, the structure connecting the overflow wall and the inner weir to form a drainage basin with at least one drain hole; wherein the top surface of the inner weir is below the bottom of the at least one recess.

13 Claims, 6 Drawing Sheets

PARTICLE BARRIER DRAIN

CROSS-REFERENCE TO RELATED APPLICATIONS

This application claims the benefit of Provisional Application No. 60/257,562 filed Dec. 22, 2000.

BACKGROUND OF THE INVENTION

1. Field of the Invention

The present invention relates to the fabrication of integrated circuits, and more particularly to an apparatus and process that facilitates the uniform overflow of a liquid containing contaminants from a process tank and prevents the contaminated liquid from reentering the process.

2. Description of the Prior Art

Integrated circuit devices are produced on semiconductor wafers where each wafer can produce a multitude of integrated circuit devices. The exact number of devices that can be produced on any single wafer depends both on the size of the wafer and the size of the devices being produced thereon. In the production of integrated circuit devices, the importance of minimizing the amount of contaminants on the wafers at all stages of processing has long been recognized in the industry. Contaminants cause otherwise properly processed devices to not function properly upon completion of the production process. As a result of this contamination, the yield of properly functioning devices obtained from any given wafer decreases.

Moreover, cleanliness requirements have become increasingly important as a result of the devices becoming more and more miniaturized. When dealing with reduced size devices, the ratio of the size of a contaminant compared to the size of a device is greater, resulting in an increased likelihood that a contaminated device will not function properly. Thus, increasingly stringent cleanliness requirements are needed. As a result, improved semiconductor wafer processing techniques that reduce the amount and size of the contaminants present during wafer production are highly desired.

One method used to clean wafers that is known in the art is overflow. In overflow washers, wafers are cleaned by supplying a rinsing liquid through the bottom of a tank in which the wafers are located. The liquid is continuously supplied so that the liquid eventually fills the tank and overflows its sides. The theory behind the cleaning function of overflow washers is that as the tank fills with fresh, clean liquid, the dirtier liquid that contains contaminants that have been removed from the wafers is removed from the upper portion of the tank by overflow, the dirty liquid being continuously replaced with fresh, clean liquid. Additionally, many overflow washers also include a bubbler which introduces a stream of nitrogen bubbles into the bottom of the tank to enhance the rinsing action of the flowing liquid and which helps carry contaminants to the surface of the liquid where they will be removed from the tank by the overflowing liquid. Another technique utilized in the art to increase the cleanliness of the liquid used in overflow washers is to facilitate uniform overflow of the liquid from the tank. Uniform overflow is accomplished in the art by providing a multitude of peaks at or near the top of the tank walls, these peaks in turn forming a corresponding recess between each pair of peaks. The surface liquid overflows the tank walls through such recesses, causing the liquid to overflow the tank walls from all sides and thus facilitating a uniform overflow of surface liquid from the tank. Because a uniform overflow of liquid more effectively removes contaminants located on or near the surface of the liquid than a non-uniform overflow of liquid, the liquid remaining in the tank contains less contaminant and is cleaner.

While employing recesses does facilitate uniform overflow, the surface liquid overflows the tank walls only through the recesses. This results in a small area of surface fluid maintaining a steady state (i.e. a zero flow rate) at each peak of the tank walls. This lack of flow near the peaks of the tank walls results in contaminants that are present in the surface tension of the liquid adhering to the peaks of the tank walls. As the surface liquid continues to overflow the tank through the recesses, a significant amount of contaminants can build up at the peaks. When the supply of liquid to the tank is stopped and the remaining liquid is drained from the tank, some of these contaminants will migrate back over the surface of the liquid. As the surface level of the liquid lowers past the wafers, some of these contaminants often come back into contact with the cleaned wafers, resulting in re-contamination of the wafers and an increase in the number of devices that will not function properly.

Thus, there is a need for a system that can facilitate the uniform overflow of liquid from a tank without allowing contaminants to reenter that area of the tank in which the wafers are located.

SUMMARY OF THE INVENTION

These needs and others are met by the present invention which comprises in one aspect system that facilitates the uniform overflow of liquid from a process tank while preventing contaminants from reentering the process tank upon draining the process tank. The system comprises an inner weir having a top surface; an overflow wall having a top with at least one recess, the at least one recess having a bottom; wherein the top surface of the inner weir is below the bottom of the at least one recess; and a structure connecting the overflow wall and the inner weir so as to form a drainage basin, the drainage basin having at least one drain hole.

Preferably, the top surface of the inner weir has an inside edge and an outside edge, the top surface of the inner weir being tapered downwardly from the inside edge to the outside edge, wherein the inside edge of the top surface is below the bottom of the at least one recess. The at least one recess can be saw-toothed, rectangular, or semi-circular.

Optionally, the system also comprises a drain valve that is fluidly connected to the at least one drain hole. The drain valve has an open and closed position so that the at least one drain hole is hermetically sealed when the drain valve is closed and allows fluid to freely flow through the at least one drain hole when the drain valve is opened.

In the preferred embodiment, the system of invention comprises an inner weir having a top surface; an overflow wall having a top with at least one recess, the at least one recess having a bottom; wherein the top surface of the inner weir is below the bottom of the at least one recess; and a structure connecting the overflow wall and the inner weir so as to form a drainage basin, the drainage basin having at least one drain hole; a drain valve fluidly connected to the at least one drain hole, the drain valve having an open and closed position so that the at least one drain hole is hermetically sealed when the drain valve is closed and allows fluid to freely flow through the at least one drain hole when the drain valve is opened; wherein the top surface of the inner weir has as inside edge and an outside edge, the top surface of the inner weir being tapered downwardly from the inside edge to the outside edge, wherein the inside edge of the top surface is below the bottom of the at least one recess; and wherein the at least one recess is saw-toothed.

In another embodiment, the invention is a process tank comprising the system of invention described above. The process tank can be a rinsing tank, a drying tank, or a chemical treatment tank.

In even another embodiment, the invention is a method of facilitating uniform overflow of liquid from a process tank while preventing contaminants from reentering the process tank upon draining the process tank. The method comprises the steps of: providing a process tank comprising the system of invention described above; supplying a liquid to the process tank wherein the liquid comprising contaminants overflows the inner weir, fills the drainage basin, and overflows the overflow wall through the at least one recess of the overflow wall; and wherein upon discontinuing the supply of liquid to the process tank, the contaminants do not reenter the process tank.

Optionally, the at least one drain hole used in this method is fluidly connected to a drain valve having an open and closed position so that the at least one drain hole is hermetically sealed when the drain valve is closed and allows fluid to freely flow through the at least one drain hole when the drain valve is opened.

Preferably, in performing the method above, the drain valve is opened essentially in concurrence with discontinuing the supply of liquid to the process tank.

The top surface of the inner weir can have an inside edge and an outside edge, wherein the top surface of the inner weir is tapered downwardly from the inside edge to the outside edge, wherein the inside edge of the top surface is below the bottom of the at least one recess. Also, the at least one recess can be saw-toothed, rectangular, or semi-circular.

In the preferred embodiment, the method of invention comprises providing a process tank comprising the system of invention described above; supplying a liquid to the process tank wherein the liquid comprising contaminants overflows the inner weir, fills the drainage basin, and overflows the overflow wall through the at least one recess of the overflow wall; and wherein upon discontinuing the supply of liquid to the process tank, the contaminants do not reenter the process tank; wherein the at least one drain hole is fluidly connected to a drain valve having an open and closed position so that the at least one drain hole is hermetically sealed when the drain valve is closed and allows fluid to freely flow through the at least one drain hole when the drain valve is opened; wherein the top surface of the inner weir has an inside edge and an outside edge, the top surface of the inner weir being tapered downwardly from the inside edge to the outside edge, wherein the inside edge of the top surface is below the bottom of the at least one recess; and wherein the at least one recess is saw toothed.

DETAILED DESCRIPTION OF THE DRAWINGS

Figure 1:
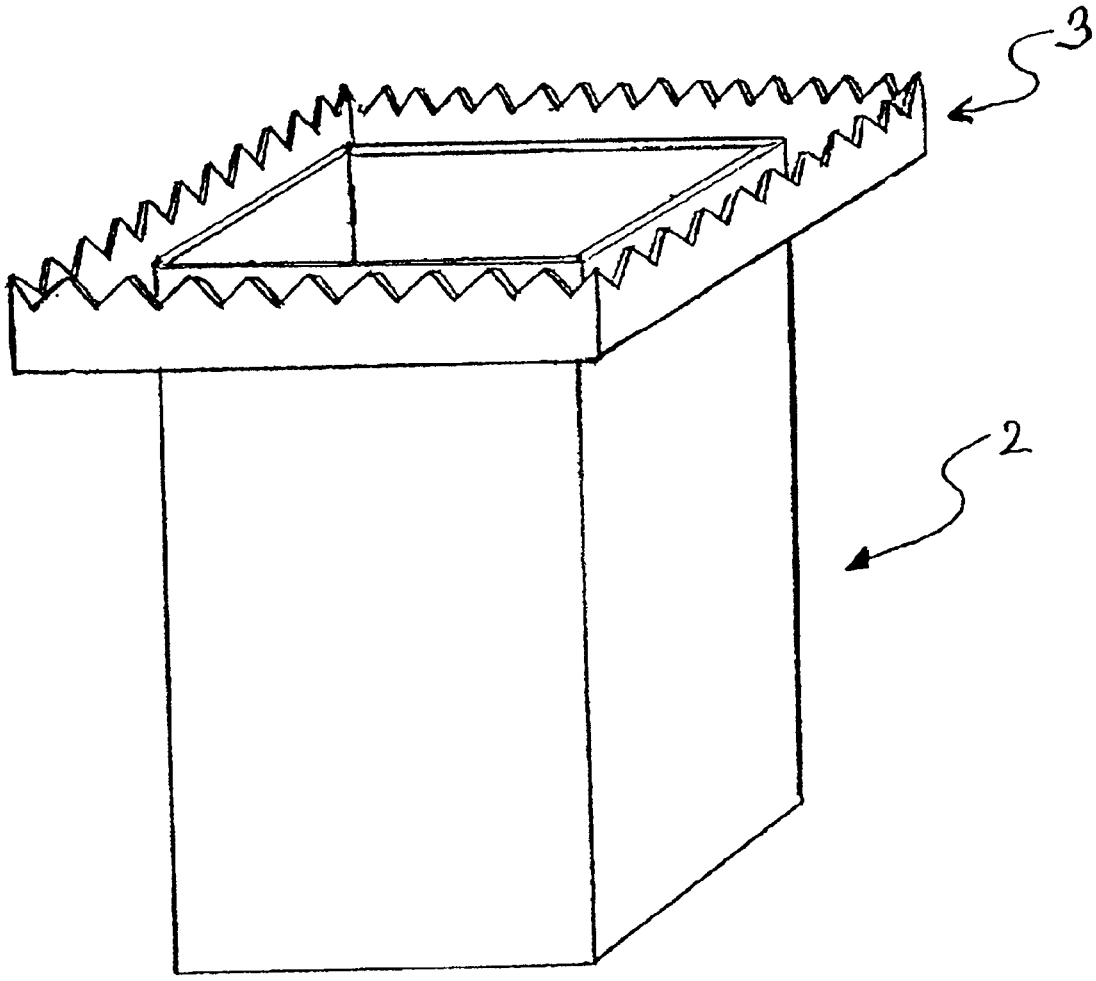
FIG. 1 is an elevational view of a square process tank implementing the system of the present invention.

FIG. 1 is an elevational view of a process tank 2 embodiment of the present invention having a particle barrier drain 3.

Figure 2:
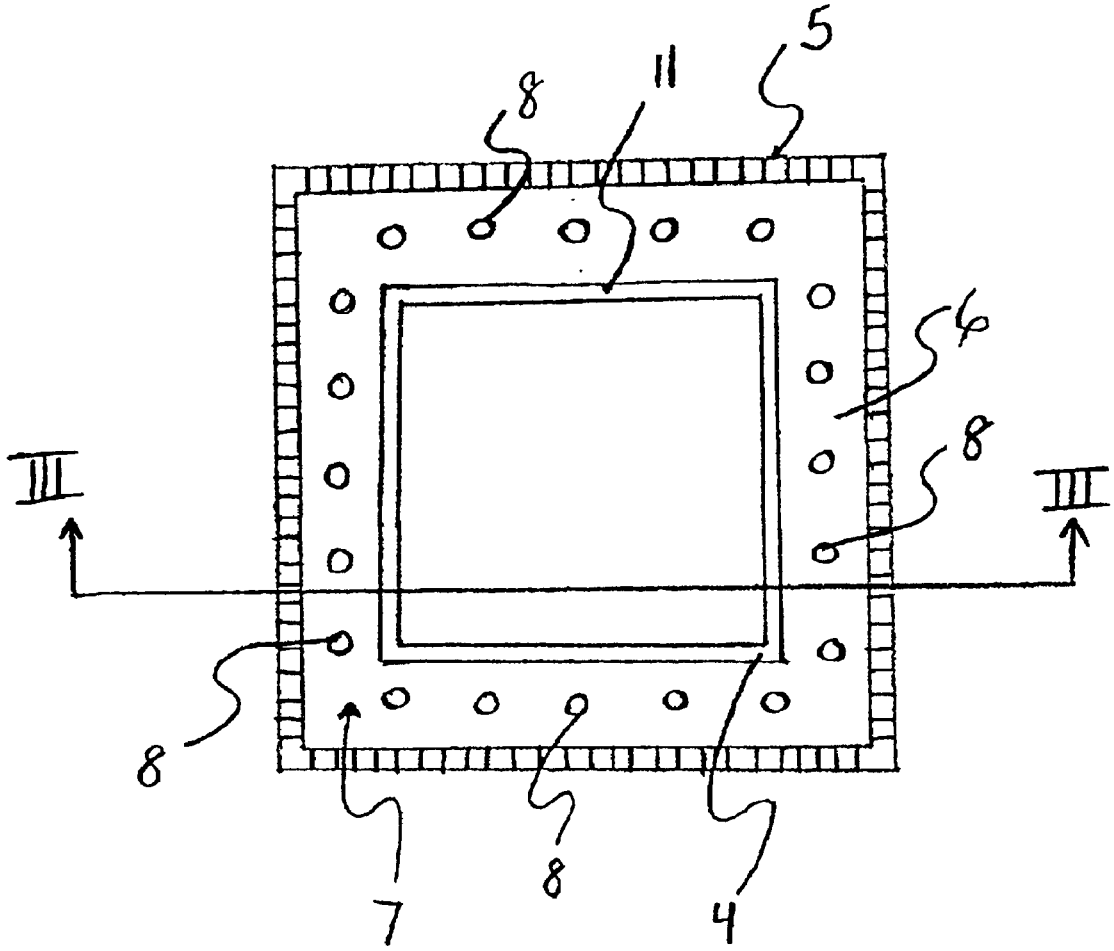
FIG. 2 is a top view of the square process tank implementing the system of the present invention.
Figure 3:
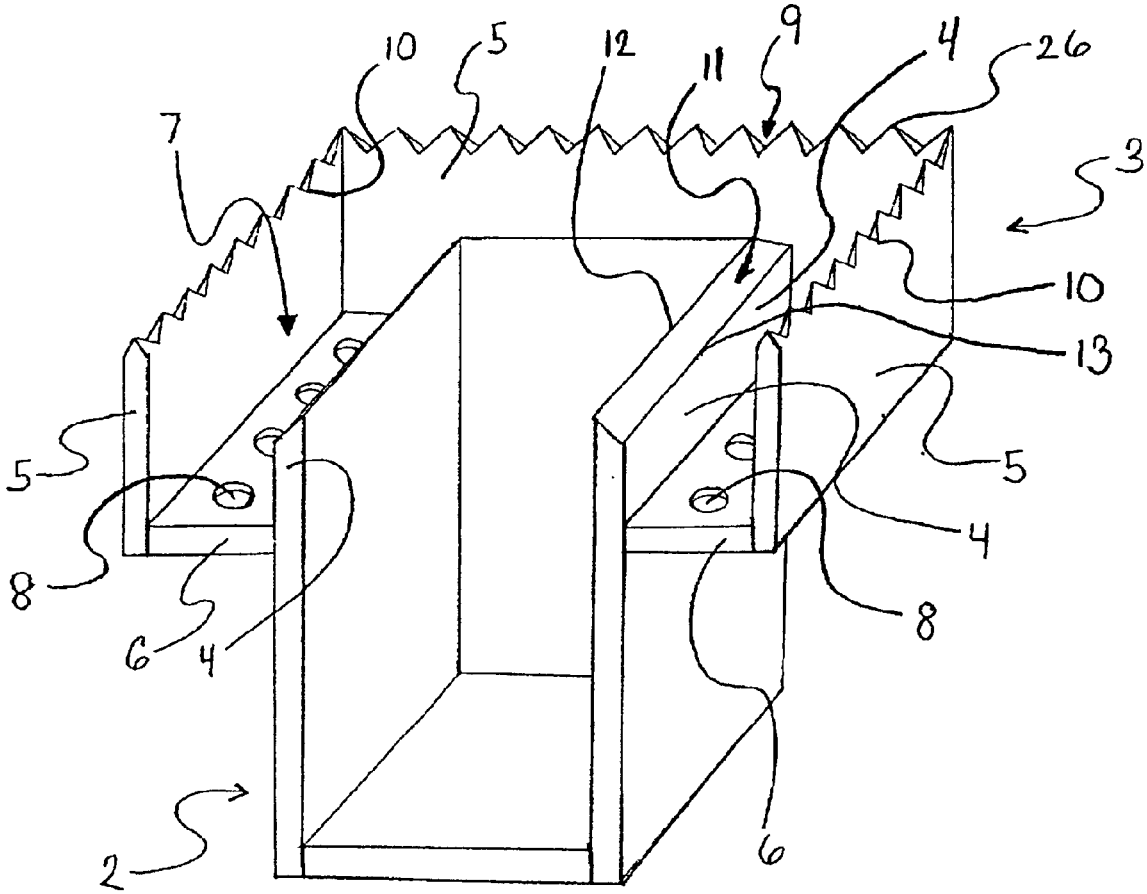
FIG. 3 is a cross-sectional view of the square process tank implementing the system of the present invention taken along line III—III.
Figure 4B:
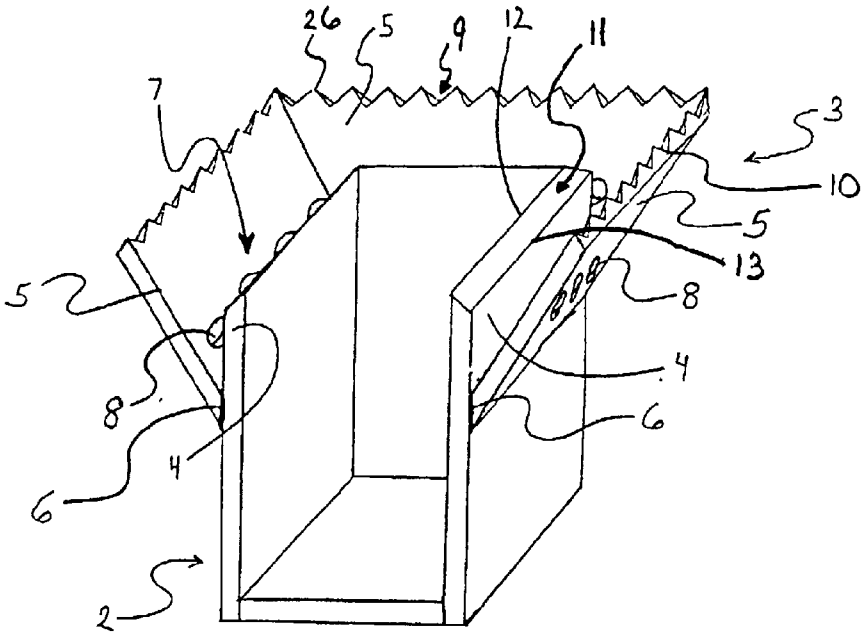
FIG. 4B is a process tank implementing the system of the present invention wherein the connecting structure is a point of connection.
Figure 4A:
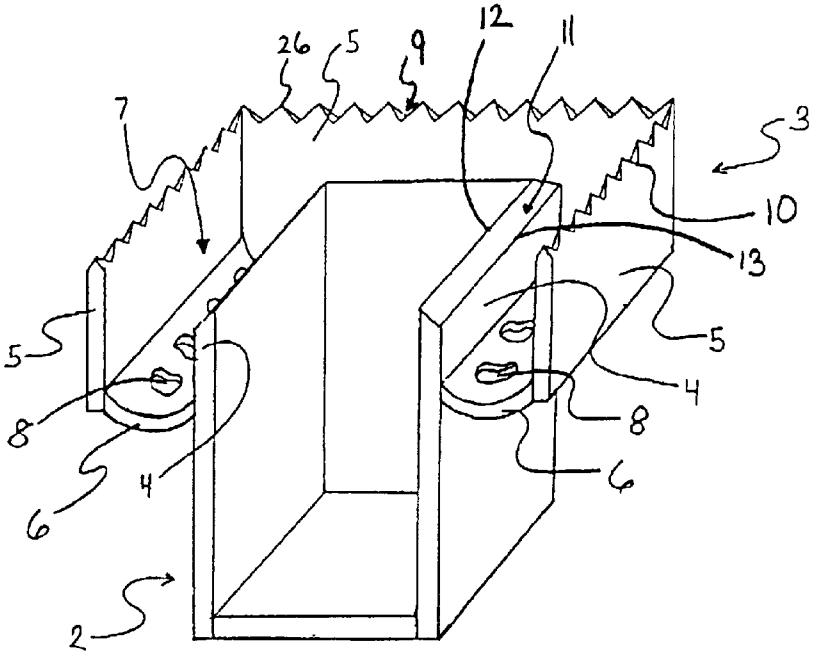
FIG. 4A is a process tank implementing the system of the present invention wherein a connecting structure is a curved surface.

Referring to FIGS. 2 and 3, particle barrier drain 3 (FIG. 3) comprises an inner weir 4, an overflow wall 5, and a structure 6. In the illustrated embodiment, inner weir 4 is the top of the walls of process tank. However, the inner weir can be a separate component that fluidly connects to the walls of the process tank. Structure 6 connects overflow wall 5 and inner weir 4 so that drainage basin 7 is formed. In the preferred embodiment, structure 6 is a flat surface. However, in alternate embodiments structure 6 can be a curved surface or merely a point of connection (FIGS. 4A and 4B).

Referring back to FIGS. 2 and 3, drain basin 7 has at least one drain hole. In the illustrated embodiment, a plurality of drain holes 8 are located on structure 6 and are spaced throughout the entirety of drainage basin 7. Overflow wall 5 has a at least one recess 9 located near the top of overflow wall 5 and formed by peaks 26 of overflow wall 5. The recess as 9 have bottoms 10. In the illustrated embodiment, overflow wall 5 has a plurality of saw-toothed recesses 9 located around the entire perimeter of overflow wall 5. However, recesses 9 can be any shape, for example rectangular, circular, or semi-circular.

Inner weir 4 has top surface 11. In order facilitate uniform overflow while preventing contaminants from reentering process tank 2, top surface 11 is just below the bottom 10 of the at least one recess 9. In the preferred embodiment, top surface 11 has inner edge 12 and outer edge 13, wherein top surface 11 is tapered downwardly from inside edge 12 to outside edge 13. In the preferred embodiment, inside edge 12 is just below the bottom 10 of the at least one recess 9.

Figure 5:
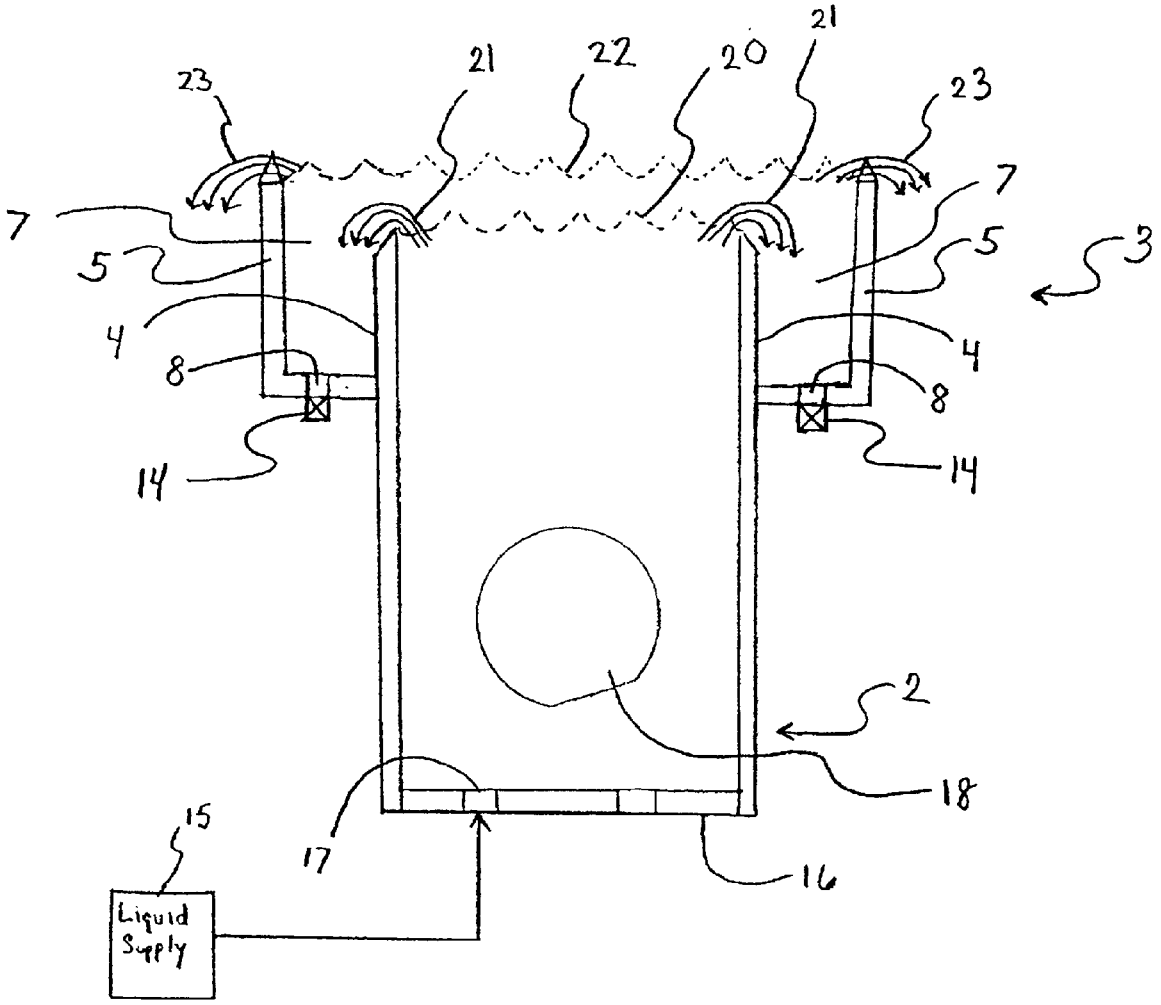
FIG. 5 is cross-section of a process tank implementing the system of the present invention illustrating filling and overflowing the process tank and the system of the present invention with liquid.

Referring to FIG. 5, particle barrier drain 3 optionally comprises drain valve 14. Drain valve 14 is fluidly connected to the at least one drain hole 8. In those embodiments of the invention employing a plurality of drain holes 8, drain valve 14 is fluidly connected to each drain hole 8. Drain valve 14 has an open and closed position. Liquid can freely flow through the at least one drain hole 8 when drain valve 14 is opened. However, when drain valve 14 is closed, drain hole 8 is hermetically sealed, preventing any liquid from flowing through drain hole 8.

In operating the system according to the present invention, process tank 2 has a tank bottom 16. One or more wafer substrates 18 are placed in process tank 2. Liquid is supplied to process tank 2 by liquid supply 15 through supply opening 17 in tank bottom 16. Liquid is supplied until process tank 2 is filled and the liquid surface level is at position 20. Liquid supply 15 continues to supply liquid to process tank 2, causing spill over 21 of the liquid over inner weir 4. The liquid continues to be supplied, filling drainage basin 7 until the liquid surface level reaches position 22. In order to fill drainage basin 7, either drain valves 14 are closed or the liquid supply flow rate must be greater than the flow rate of liquid draining through drain holes 8. In the preferred embodiment, drain valves 14 are closed.

Once the liquid surface level is at position 22, liquid continues to be supplied to process tank 2, causing overflow 23 of the liquid over the over flow wall 5 through the at least one recess 9 (FIG. 4A). Because recesses 9 are located around the perimeter of overflow wall 5 overflow 23 is uniform over all sides of overflow wall 5. Overflow 23 through recesses 9 results in contaminants building up on peaks 26 of overflow wall 5.

Figure 6:
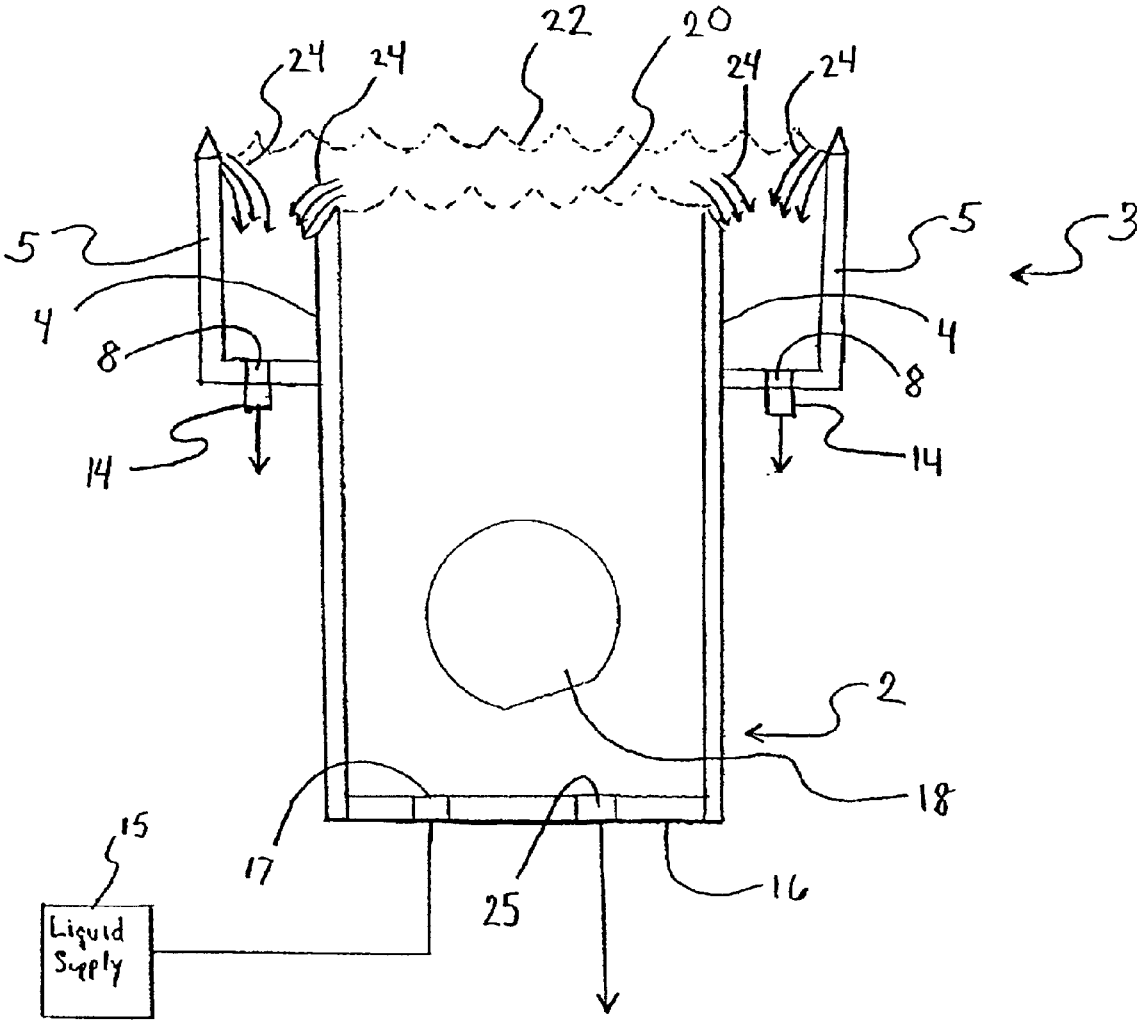
FIG. 6 is cross-section of a process tank implementing the system of the present invention illustrating draining the process tank and the system of the present invention.

Referring to FIG. 6, inner weir 4 prevents the contaminants that have built up on peaks 26 from reentering process tank 2 upon draining process tank 2. In draining the liquid according to the present invention, liquid supply 15 is discontinued. Once liquid supply 15 is discontinued, the liquid surface level stabilizes at position 22. At this point, in the preferred embodiment, drain valves 14 are opened. Once drain valves 14 are opened, the liquid drains through drain holes 8. The drain flow pattern 24 of the liquid is such that the liquid near overflow wall 5 which contains the built up contaminants drains through drain holes 8. Any contaminants that have built up near overflow wall 5 are prevented from flowing into process tank 2 by inner weir 4 which acts as a barrier as soon as it breaks through the lowering liquid surface. The liquid surface level eventually reaches and stabilizes at position 20 as a result of the liquid draining solely from drain holes 8. The remaining liquid is then drained from process tank 2 through tank drain 25. The system of the present invention can be used in any stage of integrated circuit processing in which a decrease in the number of contaminants that contact wafer 18 is desired. As such, process tank 2 can be a drying tank, a rinsing tank, or a chemical treatment tank.

While the invention has been described and illustrated in detail, various alternatives and modifications will become readily apparent to those skilled in the art without departing from the spirit and scope of the invention.

What is claimed is:

1. A system comprising:

an inner weir having a top surface that is free of recesses;

an overflow wall surrounding the inner weir and having a top with at least one recess, the at least one recess having a bottom;

wherein the top surface of the inner weir is below the bottom of the at least one recess; and a structure connecting the overflow wall and the inner weir so as to form a drainage basin, the drainage basin having at least one drain hole.

2. The system of claim 1 wherein the top surface of the inner weir has an inside edge and an outside edge, the top surface of the inner weir being tapered downwardly from the inside edge to the outside edge, wherein the inside edge of the top surface is below the bottom of the at least one recess.

3. The system of claim 1 wherein the at least one recess is saw toothed, rectangular, or semi-circular.

4. The system of claim 1 further comprising a drain valve fluidly connected to the at least one drain hole, the drain valve having an open and closed position so that the at least one drain hole is hermetically sealed when the drain valve is closed and allows fluid to freely flow through the at least one drain hole when the drain valve is opened.

5. The system of claim 1 further comprising a drain valve fluidly connected to the at least one drain hole, the drain valve having an open and closed position so that the at least one drain hole is hermetically sealed when the drain valve is closed and allows fluid to freely flow through the at least one drain hole when the drain valve is opened; wherein the top surface of the inner weir has as inside edge and an outside edge, the top surface of the inner weir being tapered downwardly from the inside edge to the outside edge, wherein the inside edge of the top surface is below the bottom of the at least one recess; and wherein the at least one recess is saw toothed.

6. A process tank comprising the system of claim 1.

7. The process tank of claim 6 wherein the process tank is a rinsing tank, a drying tank, or a chemical treatment tank.

8. A method comprising the steps of:

providing a process tank comprising the system of claim 1;

supplying a liquid to the process tank wherein the liquid comprising contaminants overflows the inner weir, fills the drainage basin, and overflows the overflow wall through the at least one recess of the overflow wall; and wherein upon discontinuing the supply of liquid to the process tank, the contaminants do not reenter the process tank.

9. The method of claim 8 wherein the at least one drain hole is fluidly connected to a drain valve having an open and closed position so that the at least one drain hole is hermetically scaled when the drain valve is closed and allows fluid to freely flow through the at least one drain hole when the drain valve is opened.

10. The method of claim 9 wherein the drain valve is opened essentially in concurrence with discontinuing the supply of liquid to the process tank.

11. The method of claim 8 wherein the top surface of the inner weir has an inside edge and an outside edge, wherein the top surface of the inner weir is tapered downwardly from the inside edge to the outside edge, wherein the inside edge of the top surface is below the bottom of the at least one recess.

12. The method of claim 8 wherein the at least one recess is saw toothed, rectangular, or semi-circular.

13. The method of claim 8 wherein the at least one drain hole is fluidly connected to a drain valve having an open and closed position so that the at least one drain hole is hermetically sealed when the drain valve is closed and allows fluid to freely flow through the at least one drain hole when the drain valve is opened, wherein the top surface of the inner weir has an inside edge and an outside edge, the top surface of the inner weir being tapered downwardly from the inside edge to the outside edge, wherein the inside edge of the top surface is below the bottom of the at least one recess; and wherein the at least one recess is saw toothed.

* * * * *